United States Patent [19]

Dunton et al.

[11] Patent Number: 4,872,913

[45] Date of Patent: Oct. 10, 1989

[54] APPARATUS AND METHOD TO PRODUCE FOAM, AND FOAMED CONCRETE

[75] Inventors: Harvey R. Dunton, Victorville; Donald H. Rez, Newport Beach, both of Calif.

[73] Assignee: Standard Concrete Products, Inc., Santa Ana, Calif.

[21] Appl. No.: 208,579

[22] Filed: Jun. 20, 1988

Related U.S. Application Data

[63] Continuation of Ser. No. 3,028, Jan. 12, 1987, abandoned.

[51] Int. Cl.[4] ..... C04B 24/14; C04B 38/10

[52] U.S. Cl. ..... 106/88; 106/91; 106/93

[58] Field of Search ..... 106/86, 88, 90, 97, 106/91, 93

[56] References Cited

U.S. PATENT DOCUMENTS

| | | | |
|---|---|---|---|
| 2,432,971 | 12/1947 | Ruthman | 106/93 |
| 2,549,507 | 4/1951 | Morgan et al. | 106/93 |
| 2,600,018 | 6/1952 | Nelson et al. | 106/86 |
| 2,629,667 | 2/1953 | Kaveler | 106/93 |
| 2,700,615 | 1/1955 | Heijmer | 106/93 |
| 2,820,713 | 1/1958 | Wagner | 106/93 |
| 2,864,714 | 12/1958 | Dixon Jr. et al. | 106/88 |
| 2,959,489 | 11/1960 | Wagner | 106/90 |
| 3,030,258 | 4/1962 | Wagner | 106/93 |
| 3,169,877 | 2/1965 | Bartoli | 106/93 |
| 3,215,549 | 11/1985 | Ericson et al. | 106/90 |
| 4,585,486 | 4/1986 | Fujita et al. | 106/86 |
| 4,708,745 | 11/1987 | Schönhausen | 106/88 |

OTHER PUBLICATIONS

Mish et al., "*Webster's* . . . ", Merriams Webster Corp. Springfield, Mass., 1986, p. 1055.

Search Documents (numbered 1–36).

*Primary Examiner*—Mark L. Bell

*Assistant Examiner*—David M. Brunsman

*Attorney, Agent, or Firm*—William W. Haefliger

[57] ABSTRACT

A method for forming foam, useful in mixing with concrete at a batching plant, includes the steps:

a) supplying a synthetic resinous foaming agent, in liquid form, b) combining the foaming agent with water, to form a liquid mix, and pressurizing the mix, c) adding pressurized air to the mix, d) sub-dividing the mix into droplets, in a confined flowing stream, e) reducing the stream confinement, f) whereby the droplets expand as a foam.

8 Claims, 2 Drawing Sheets

APPARATUS AND METHOD TO PRODUCE FOAM, AND FOAMED CONCRETE

This is a continuation of U.S. patent application Ser. No. 003,028, filed Jan. 12, 1987, now abandoned.

BACKGROUND OF THE INVENTION

This invention relates generally to production and use of foam in concrete mixes, and more particularly to an efficient, simple process of producing foam used for example at batching plants, as well as apparatus to provide such foam.

It is known to employ foam in concrete to improve its use characteristics; however, it is difficult to provide and maintain correct ratios of foam producing agent in water supplied to the dry concrete mix, and correct ratios of foam to concrete, particularly at the job site, and it is found that such ratios can and do vary greatly at different job sites whereby the quality, pumpability, extrudability, and finishing characteristics of the concrete vary and suffer. There is need for simple, low-cost, and effective apparatus and method to provide required quality control of the ratios referred to and enable production of high quality concrete, in terms of pumpability, extrudability weight control, insulative and fire proofing capability, as well as other desirable qualities.

SUMMARY OF THE INVENTION

It is a major object of the invention to provide method and process apparatus, overcoming the above difficulties and problems, and providing for efficient metering and blending of foam producing chemical with water or other aqueous fluids, and mixing with air under pressure, to produce foam added to concrete mix, as at a batching plant, in correct ratio. The method may be categorized as including the steps:

(a) supplying a synthetic resinous foaming agent, in liquid form, (b) combining the foaming agent with water, to form a liquid mix, and pressurizing the mix, (c) sub-dividing the mix into droplets, in a confined flowing stream, (e) and reducing the stream confinement, (f) whereby the droplets expand as a foam.

As will be seen, the combining of foaming agent chemical with water, or aqueous fluid, typically includes pumping the mix to form the flowing stream which is pressurized, through use of a double diaphragm, positive displacement, gas or air operated pump. Such a pump incorporates certain sub-chambers for reception of air pressure to drive the pump, and other sub-chambers to receive water to be pumped, and in accordance with the invention fluid chemical metering means is provided to operate in synchronism with the pump to feed chemical to water being pumped. As will appear, the metering means may also comprise a positive displacement pump, reciprocated in response to water flow to and from the diaphragm pump, thereby to feed metered quantities of chemical in correct proportion to the water being pumped. Foam is not produced at the pump or pumps, but is produced later as air under pressure is mixed with the pre-mixed chemical foaming agent and water.

Further, the chemical and water that has been pumped at established ratios, can be kept separated and diverted to a transparent, calibrated container for visual check of exact amounts of each material, prior to discharging into the blending unit. The blending or discharging cycle is the same as the charging cycle, except the chemical, water and air are, by valve selection, pumped from the sight container and combined through static mixing chambers to produce the required density and volume of micro-spheres. The blending chambers contain filter elements in the range of 5 to 25 microns in fineness, i.e. size.

Further, the pressurized gas or air used for driving the pump, and exhausted from the pump, is typically recovered and used as a source of gas or air blended with the water-chemical mix, thereby to control the air to water, and chemical mix ratios for accurate and reliable production of foam productive of micro-sphere aggregates when added to concrete at the batching plant, such foam improves concrete pumpability and extrusion; it improves concrete finishing, insulation and stucco; and it enhances concrete fire proofing capability. The process and system furthermore provide the following advantages:

1. enchances aggregate benefaction and or replacement in concrete;

2. provides a placing, pumping, and finishing aid, for concrete;

3. assists in the concrete curing process during the hydration phases, i.e. reduction in volume change, or shrinkage, creating reduced normal cracking and increasing strength in concrete;

4. provides reduced water demand for the same consistency of plastic concrete, creating lower water to cement ratios;

5. useful in refractory type concretes with aluminate type cements;

6. useful in sound and thermal resistant, insulative type concretes;

7. enchances resistance of concrete to freezing and thawing cycles under more severe climatic conditions due to the internal void system created by the micro-spheres;

8. allows reduction of weight in structural concretes.

The system for metering and blending the various components into micro-spheres is typically inter-faced with a computerized batching console in a concrete related manufacturing operation making it completely automated.

These and other objects and advantages of the invention, as well as the details of an illustrative embodiment, will be more fully understood from the following specification and drawings, in which:

DRAWING DESCRIPTION

FIG. 1 is an elevation showing, diagrametically, the method of the invention as practiced at a concrete batching plant; and FIG. 2 is a flow diagram showing apparatus and method to produce foam for use in concrete.

DETAILED DESCRIPTION

Figure 1:
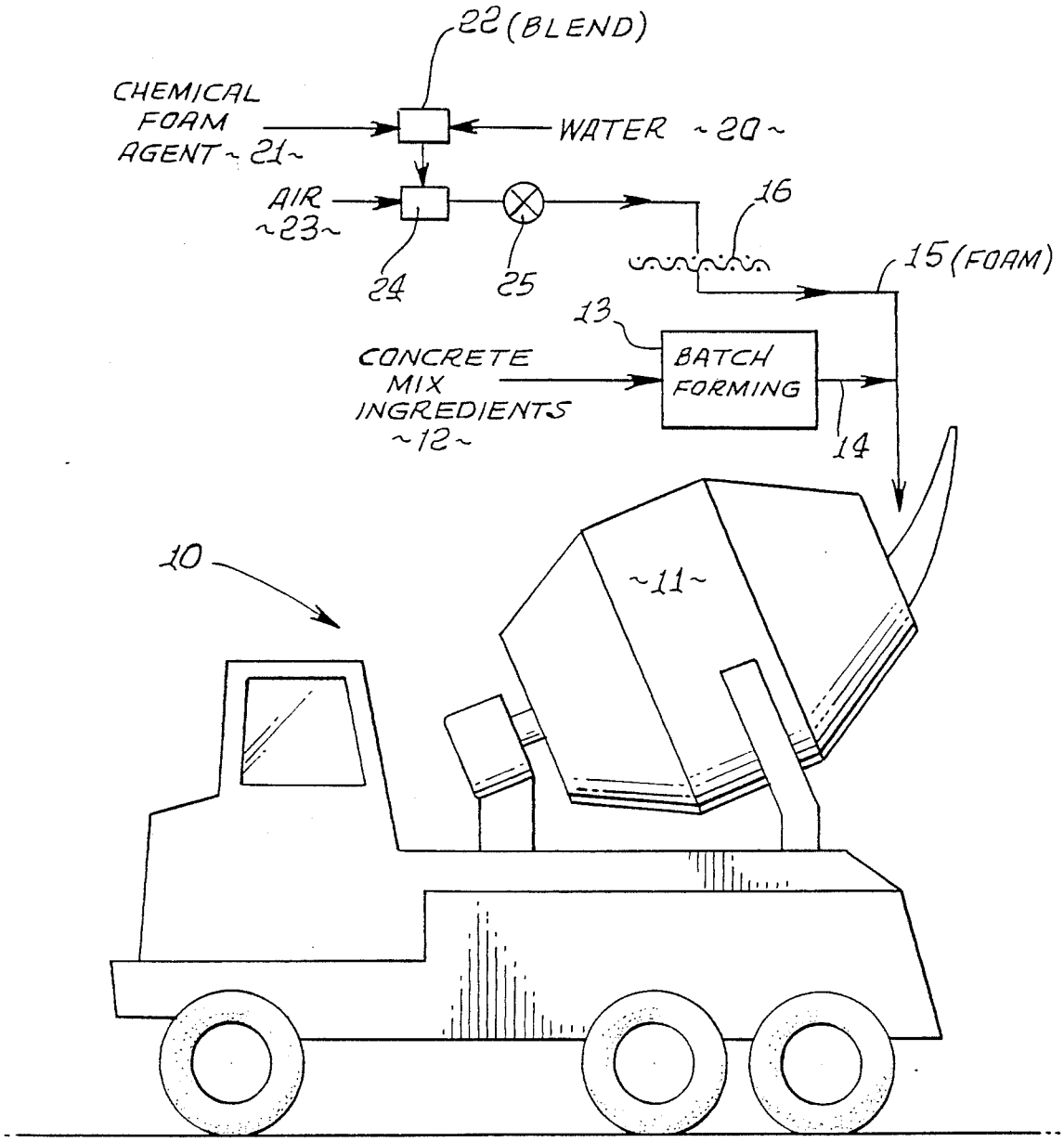

In FIG. 1 a concrete mixing truck 10 incorporates a truck body, and a rotating concrete drum 11, containing concrete to which foam has been added at batching apparatus 12. The latter includes a mixer 13 to which wet concrete is added to the mix at 15, as via a mesh or screen 16 that passes the small bubbles and rejects large bubbles. The correct amount of foam is determined for a given quantity of concrete admitted to the mixer, i.e. foam is metered, by employment of a reciprocating water or fluid pump (to be described) and a synchronously operated foaming agent pump, together with a regulated air supply, so that a metered number of pulses or reciprocations produce the required correct quantity of foam, in correct ratio to concrete, so as to ensure the desired high quality concrete. This effect is further enhanced through use of a resinous chemical foaming agent such as "CELLUCON" (essentially methyl cellulose), a product of Romaroda Chemicals Pty., Ltd., 226 Princes Highway Dandenong, Victoria, Australia.

In FIG. 1, pressurized water 20 and chemical foaming agent 21 are mixed at 22, and the mix is blended with air 23 under pressure, at zone 24, to produce foam as the pressure is reduced as through a valve 25. The foam may be passed through a mesh or screen at 26 so that only the smaller i.e. micro sized spherical bubbles of foam pass to the concrete in the mix. Typically between 178 and 5 cubic feet of foam are added to each cubic yard of concrete, for best results. The bubbles in essence take the place of sand particles, volumetrically, to produce a lightweight concrete, and are of about the size of cement particles.

Figure 2:
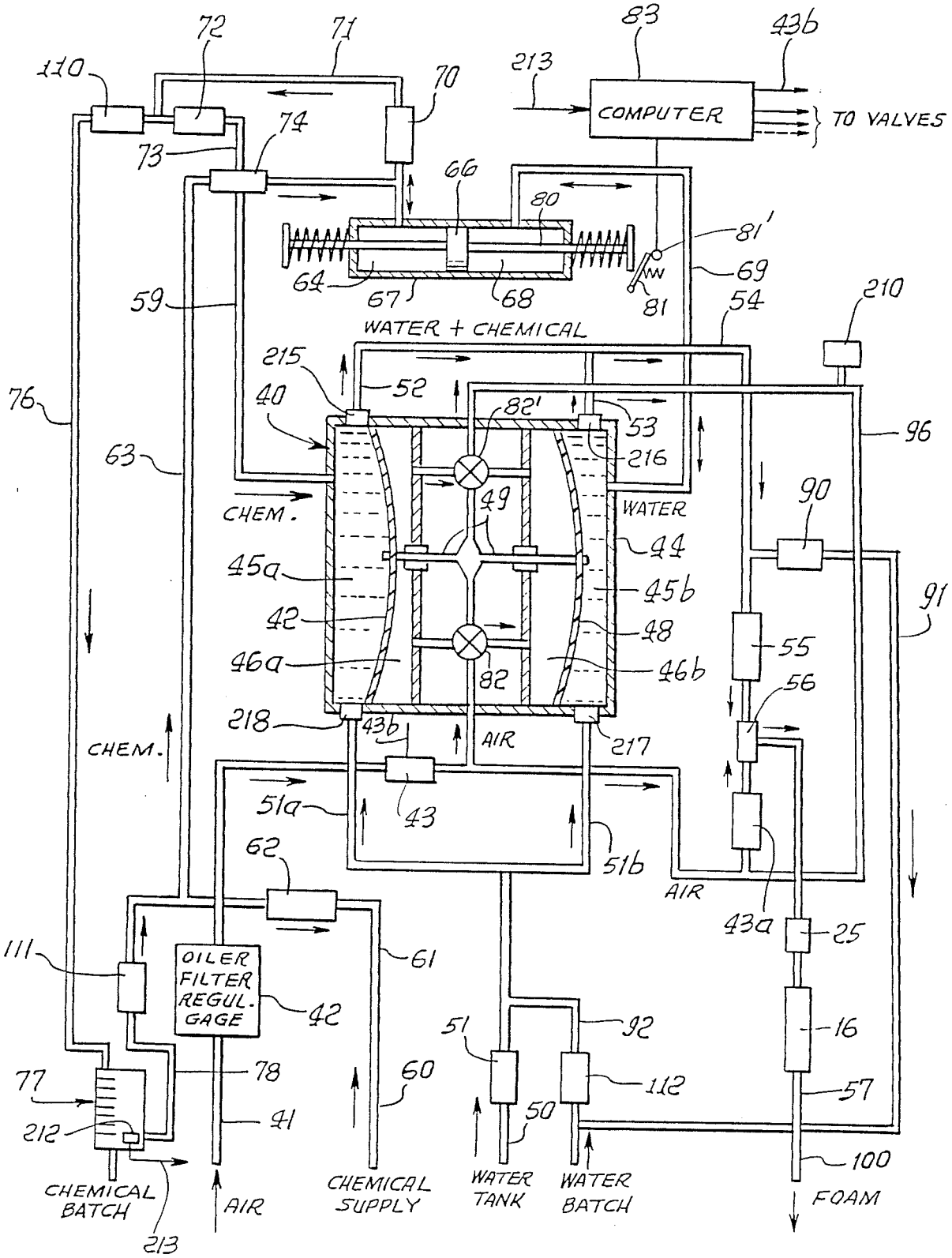

In FIG. 2 a double displacement pump 40 is air pressure driven. Air under pressure is passed at 41 through and air pressure regulator 42 and through a valve 43 to the pump 40. Typical air pressure is about 80 psi. The pump includes a housing 44 and two chambers 45 and 46. Diaphragms 42, 48 divide the chambers into sub-chambers 45*a* and 45*b*, and 46*a* and 46*b*. The diaphragms are interconnected at 49 so that they reciprocated together. Air pressure is admitted to the two sub-chambers 45*a* and 46*a* alternately, to effect such reciprocation. See valves 82 and 83.

Water is supplied via line 50, valve 51 and lines 51*a* and 51*b* to the sub-chambers 45*a* and 45*b* alternately, and pumped from such chambers via lines 52 and 53 to a line 54 leading via valve 55 to a mixer at 56; at the latter, water, with chemical added in correct ration, mixes with pressurized air to produce foam in line 57, and added to a concrete mix at the batching plant, and for delivery to a job site. Note air supply from check valve 43 to adjustable valve 43*a*. Also, discharged air from chambers 46*a* and 46*b* flows via valve 83 and line 96 to valve 43*a* and 56. The pressurized air added to the water and chemical mix, under pressure, causes subdivision of the mix into droplets in a confined flowing stream, which expands the droplets into foam. Excess water flows from line 54 via check valve 90 and line 91 to feed a water batch line 92 supply to lines 51*a* and 51*b*.

A metered amount of foam producing chemical is supplied to water in sub-chamber 45*b* of the pump, via line 59. Such metering of the chemical is controlled by stroking of the pump diaphragm 42. For this purpose, chemical is supplied as at 60 to flow via line 61, valve 62, line 63 and valve 79 to the left chamber 64 as a piston 66 moves to the right in cylinder 67. Thus, enlargement of chamber 64 produces suction action to draw chemical into that chamber 64. In this regard, piston 66 is drawn to the right by withdrawal of water from right chamber 68, as pump diaphragm 48 moves to the left, there being a water line 69 connecting chamber 68 with pump sub chamber 46*b*. Water also enters sub chamber 46*b* via line 51*b* at such time.

When diaphragm 48 moves to the right, water under pressure is ejected from sub-chamber 46*b* to flow to chamber 68, and also to flow at 53 to line 54, as described above.

As piston 61 moves to the left, in response to pressurized water flow to right chamber 68, chemical is discharged from left chamber 64 to flow via valve 70 line 71, valve 72, line 73, and valve 74 to line 59 and sub-chamber 45*b*, as described above. Chemical is also pumped via line 76 to a sight glass 77, for visual inspection of chemical quantity (i.e. to assure that chemical is always in supply at correct amount), and re-circulation at 78 to line 63.

Each time piston 66 moves to the right, a piston rod 80 extending from the cylinder 67 activates a switch arm 81 to engage a contact 82, for producing a pulse feed to a computer indicated at 83. The latter counts the pulses, and derives a rate of chemical flow to the apparatus. If the rate is above a pre-set range, the computer re-sets, i.e. lowers, the regulated air pressure delivery, via regulator 42, to the pump, to reduce the rate of foam production; and if the pulse rate is too low, the regulated air pressure is increased to increase the rate of foam production. This adjustment may be made manually.

See also control valves 110 to 112.

We claim:

1. The method of producing an improved concrete that includes:

(a) providing a synthetic resinous foaming agent, in liquid form, to a reciprocating pump and repeatedly drawing said agent and water into the pump for combining the foaming agent with water in the pump to continuously form a liquid mix, and repeatedly discharging quantities of the liquid mix from the pump, (b) adding pressurized air to the mix discharged from the pump, sub-dividing the mix into droplets, in a confined flowing stream, and reducing the stress confinement, whereby the droplets expand to form a foam, (c) forming an aqueous calcareous concrete mix, said concrete mix containing said particles, calcareous cement particles, aggregate pieces and water, adding said foam to the concrete mix, and sizing the foam before adding it to the concrete mix, to pass only bubbles of about 5 to 25 micron sphere size to the concrete mix, and mixing together the concrete mix and added foam bubbles of said micron sphere size, (d) the ratio by volume of foam added to the concrete mix being between ½and 5 cubic feet of foam per cubic yard of concrete mix, (e) the bubbles passed to the concrete mix having substantially the same sizes as the cement particles, (f) the mix and foam being added to a rotary drum on a delivery truck, and mixing the concrete mix and foam by rotating said drum as the truck travels to a job site.

2. Lightweight concrete produced by the method of claim 1.

3. The method of claim 1 including pre-mixing the foam and concrete mix in a batching tank, and then passing the foam and concrete mix to said drum as aforesaid.

4. The method of forming a foam and calcareous concrete mix, and employing a rotating concrete mixing drum on a truck, that includes:

(a) metering amounts A of water and B of synthetic resinous foaming agent in liquid form, and sequentially combining amounts A respectively with amounts B, to form a sequence of metered and combined quantities A and B in a flowing stream, adding pressurized air to said metered and combined quantities A and B to pressurize same, in a confined stream, (b) reducing the stream confinement to allow foam production and adding the unconfined stream to the calcareous concrete mix in the rotary mixing drum, (c) and rotating the drum to mix the water, concrete mix, agent and foam thereby to enhance foam mix production and mixing as the truck moves to a job site, the foam comprising bubbles of about 5 to 25 micron sphere size only, (d) said amount of said agent being such as to form between ½ and 5 cubic feet of foam per cubic yard of the concrete mix in the rotating drum.

5. The method of claim 4 wherein saisd agent comprises methyl cellulose.

6. The method of claim 4 including providing a screen and passing foam through the screen prior to addition to the drum, to control the bubble size.

7. The method of claim 6 including pressurizing said agent added to said stream of water.

8. The method of claim 4 wherein said reducing of stream confinement is effected through a nozzle acting to subdivide the stream into droplets flowing toward the drum.

* * * * *